US006948292B2

(12) United States Patent
Romagnoli

(10) Patent No.: US 6,948,292 B2
(45) **Date of Patent: *Sep. 27, 2005**

(54) MACHINE FOR MAKING A FILTER BAG CONTAINING A SUBSTANCE FOR INFUSION WITH THE GATHERED THREAD ATTACHED TO THE PICK UP TAG

(75) Inventor: Andrea Romagnoli, San Lazzaro Di Savena (IT)

(73) Assignee: Tecnomeccanica S.r.l., Bologna (IT)

( * ) Notice: Subject to any disclaimer, the term of this patent is extended or adjusted under 35 U.S.C. 154(b) by 40 days.

This patent is subject to a terminal disclaimer.

(21) Appl. No.: 10/625,258

(22) Filed: Jul. 23, 2003

(65) Prior Publication Data

US 2004/0226263 A1 Nov. 18, 2004

(30) Foreign Application Priority Data

Jul. 23, 2002 (IT) ..... BO2002A0480

(51) Int. Cl.[7] ..... B65B 61/14

(52) U.S. Cl. ..... 53/134.2; 493/375

(58) Field of Search ..... 53/450, 455, 134.1, 53/134.2, 562; 493/375, 379; 426/410

(56) References Cited

U.S. PATENT DOCUMENTS 2,362,459 A * 11/1944 Barnett ..... 53/450
3,775,222 A 11/1973 Aspin et al.
4,078,356 A 3/1978 Gallo et al.
4,261,680 A * 4/1981 Carnley et al. ..... 414/421
4,731,974 A * 3/1988 Billi ..... 53/134.2
4,853,071 A * 8/1989 Romagnoli ..... 53/134.2
4,977,728 A * 12/1990 Rambold ..... 53/134.2
5,580,408 A 12/1996 Vernon et al.
5,749,453 A * 5/1998 Doornekamp et al. ..... 414/783
5,852,917 A * 12/1998 Romagnoli ..... 53/134.2
5,870,880 A * 2/1999 Romagnoli ..... 53/134.2
6,000,196 A * 12/1999 Boldrini et al. ..... 53/170
6,453,639 B1 * 9/2002 Sgubbi ..... 53/134.2
6,499,273 B1 * 12/2002 Marzocchi ..... 53/134.2
6,637,175 B2 * 10/2003 Ghirlandi ..... 53/134.2
6,807,793 B1 * 10/2004 Romagnoli ..... 53/134.2

OTHER PUBLICATIONS

European Search Report pertaining to EP Application No. EP 03 42 5473.

* cited by examiner

*Primary Examiner*—Louis Huynh
(74) *Attorney, Agent, or Firm*—Fay, Sharpe, Fagan, Minnich & McKee, LLP

(57) ABSTRACT

A machine (100) that makes filter bags (1) containing a product for infusion in a liquid, comprises the following, arranged in succession: a unit (53) for preparing and feeding the materials used to make the filter bags; and at least: an assembly (54) for metering the infusion product; a forming unit (55); a dividing unit (56) and a unit (57) for cutting the filter bags (1). In the preparing and feeding unit (53) three separate filter bag materials, consisting of a web (17) of filter paper, a continuous thread (31), and a row of tags (6) are gradually brought together, while moving continuously, and first loops (10) are made in the thread (31) and gathered between the tags (6). The filter bags (1) are subsequently formed in the metering assembly (54), in the dividing unit (56) and in the cutting unit (57), which also operate with continuous motion.

42 Claims, 12 Drawing Sheets

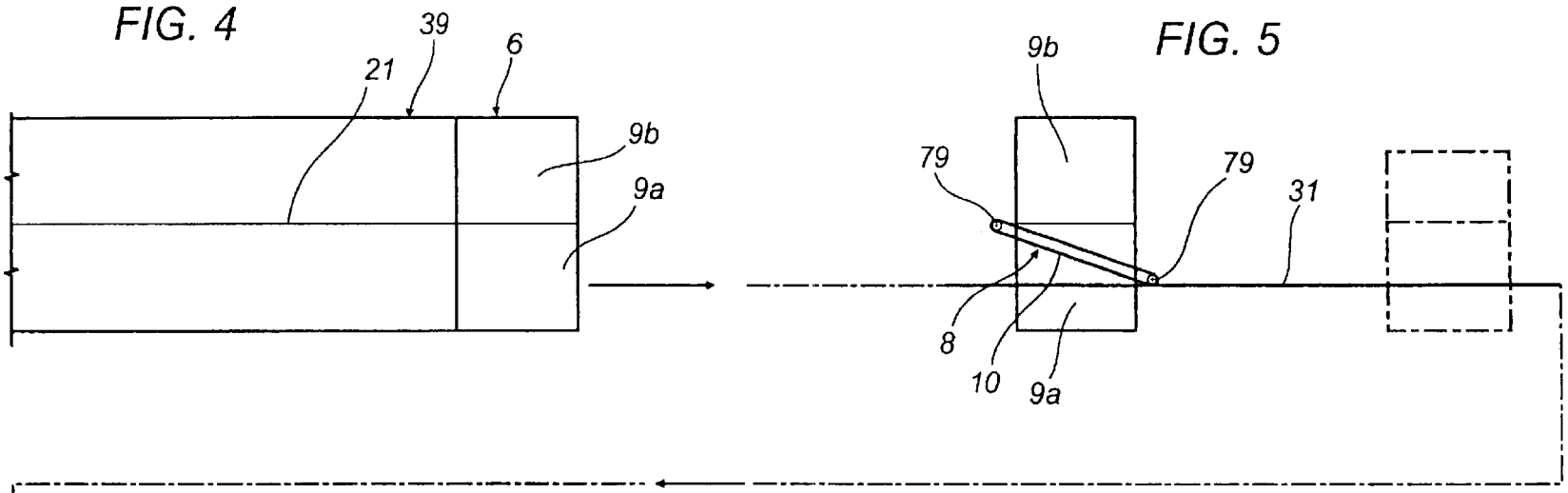
FIG. 4
FIG. 5
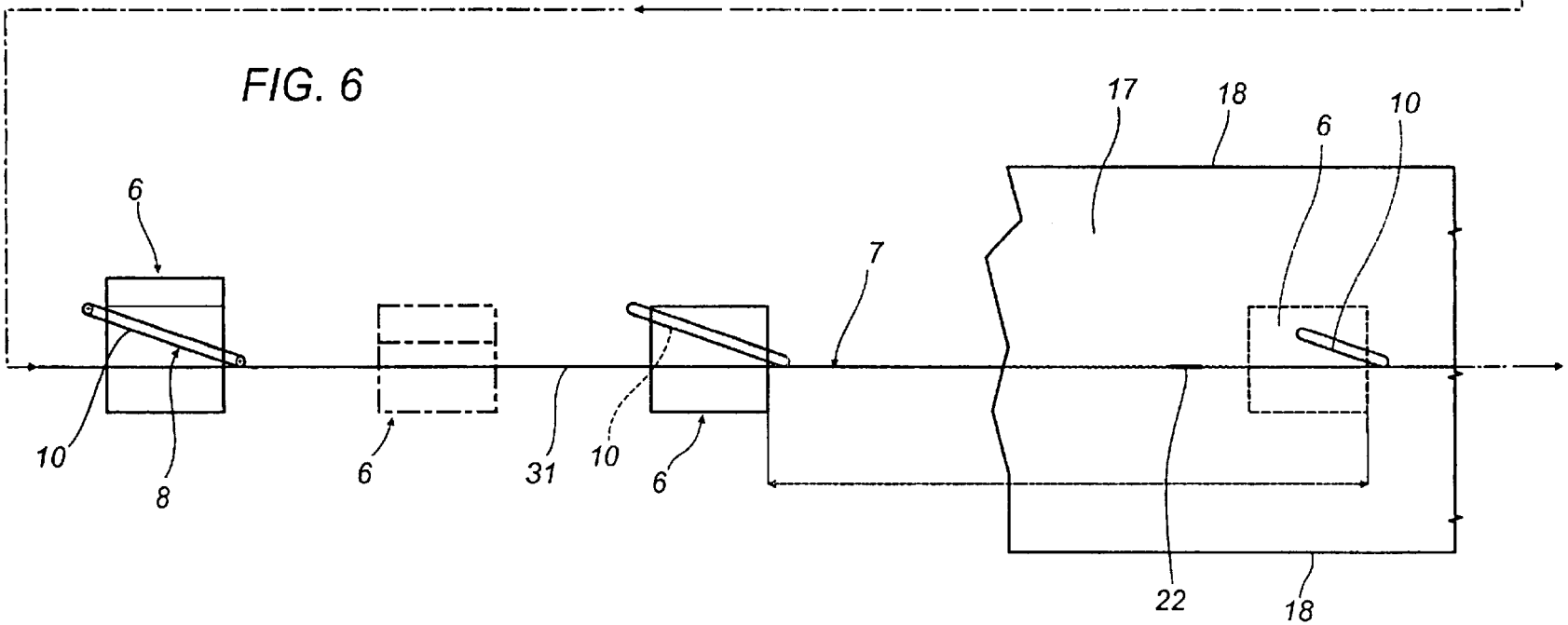
FIG. 6

MACHINE FOR MAKING A FILTER BAG CONTAINING A SUBSTANCE FOR INFUSION WITH THE GATHERED THREAD ATTACHED TO THE PICK UP TAG

BACKGROUND OF THE INVENTION

The present invention relates to the automatic production of filter paper bags containing products such as tea, chamomile and similar herbs designed to be immersed in a liquid in order to make infusions for diverse uses, for example, as beverages or for medicinal purposes.

More specifically, the invention relates to a machine for the production of filter bags made by folding and sealing webs of heat-sealable filter paper and where the thread connecting the chamber that contains the infusion product to the pick-up tag is wound around the outside of the containment chamber itself and partly enclosed, in the form of one or more closely gathered up loops, between the flaps of the pick-up tag which have been folded onto each other.

The apparatus embodies a method which, together with the filter bag made according to the method, is described in prior Italian patent application IT BO 2002A000013 in the name of the same Applicant as the present, This method essentially comprises the steps of:

forming a row of filter bag pickup-up tags by cutting a web of suitable material at regular intervals;

feeding a continuous thread above the row of tags to form, above a flap of each of the consecutive tags, a row of first loops of thread;

associating the first loops of thread with the tags;

feeding a web of heat-sealable filter paper over the continuous thread and over the tags connected to it;

pushing a portion of the thread through the web of filter paper in such a way as to form a second loop projecting from the face of the filter paper web opposite the face adjoining the tags;

folding the web of filter paper onto itself so that its edges, which were initially opposite one another, are juxtaposed in such a way as to gradually form a substantially flattened tube of filter paper;

depositing a succession of charges of the infusion product on the filter paper web, before the tube is definitively formed;

sealing the longitudinal edges of the tube;

making transversal sealed joins upstream and downstream of each tag, so as to delimit a succession of closed pouches, each containing a charge of the infusion product;

securing the portions of thread between the transversal sealed joins to the tube;

cutting the flattened tube, lying in a substantially horizontal position, into consecutive lengths;

folding each length of tube onto itself about the join between the two consecutive pouches in such a way that the two pouches are mutually superposed;

joining the pouches by a top join; and trimming the corners of the top join.

The main aim of the present invention is to provide an automatic machine embodying the method described above and capable of making the filter bags on an industrial scale.

Another aim of the invention is to provide a machine that produces the filter bags at a very high speed and whose operation is reliable.

A further aim of the invention is to produce filter bags wrapped individually in sealed, protective envelopes.

Yet another aim of the invention is to enable the filter bags, with or without envelopes, to be collectively packaged in cartons.

SUMMARY OF THE INVENTION

In accordance with the invention, these results are achieved by a machine that makes filter bags containing a product for infusion in a liquid, the machine comprising the following, arranged in succession:

a unit for preparing and feeding the materials used to make the filter bags, in which: a web of filter paper bearing a layer of heat-activated glue, a continuous thread and a row of tags are fed in coordinated fashion and associated with each other, the filter paper web and the thread moving continuously through the feed unit, while the tags and the thread are associated with each other in rhythmical sequence at the ends of thread portions which: lie lengthwise relative to the filter paper web; have a predetermined length; and are delimited at their ends by first loops made in the thread itself;

a metering assembly which places charges of the infusion product on the filter paper web;

a forming unit, a dividing unit and a cutting unit: in the forming unit, the web of filter paper being folded onto itself in such a way as to form a tube, inside which the metering assembly places charges of the infusion product, the tube then being gradually closed by sealing it along its longitudinal edges; in the dividing unit, pairs of sealed transversal joins being made in the tube upstream and downstream of each tag, these transversal seals dividing the tube into a succession of substantially flattened pouches, each containing a charge of the infusion product; in the cutting unit, the tube being cut into successive lengths, lying flat and lengthwise and each constituting the containment chamber of a filter bag.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

FIGS. 4 to 13 schematically illustrate the sequence of steps constituting the filter bag production method known from document BO2002A000013;

DESCRIPTION OF THE PREFERRED EMBODIMENTS

Figure 1:
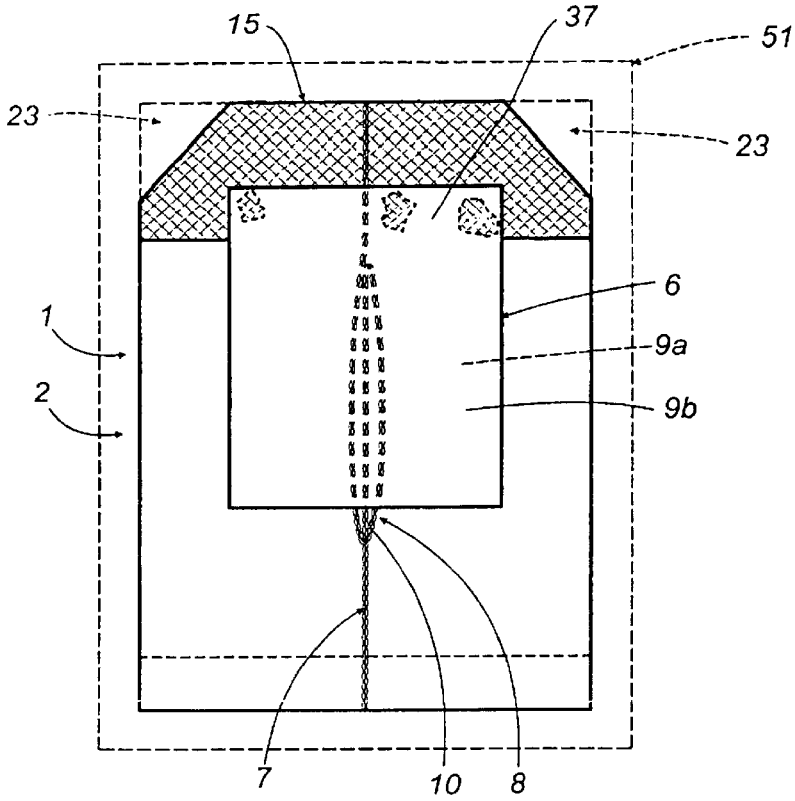
FIGS. 1, 2 and 3 are, respectively, a side assembly view, a front view and a scaled-up detail view of a filter bag of the type known from document BO2002A000013.
Figure 2:
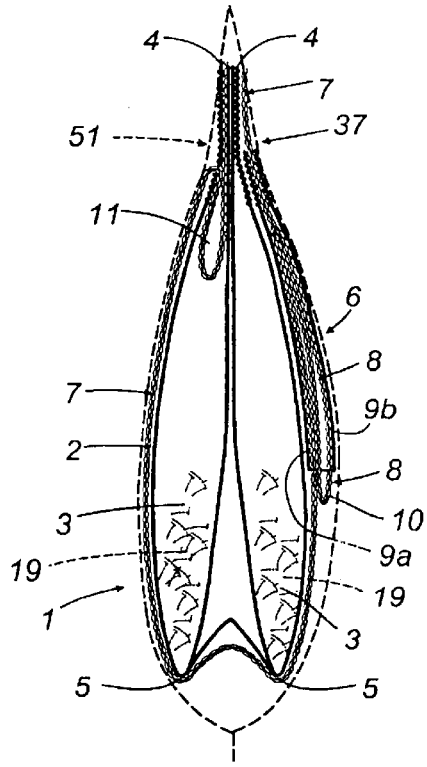
Figure 3:
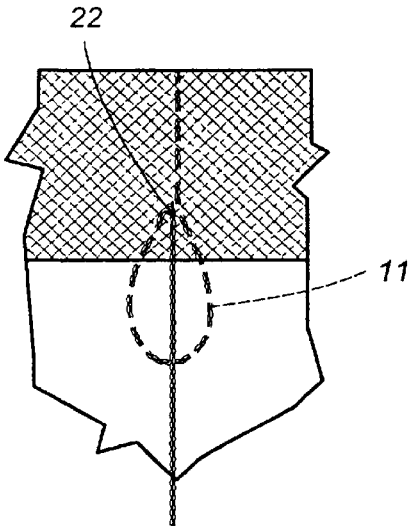
Figure 7:
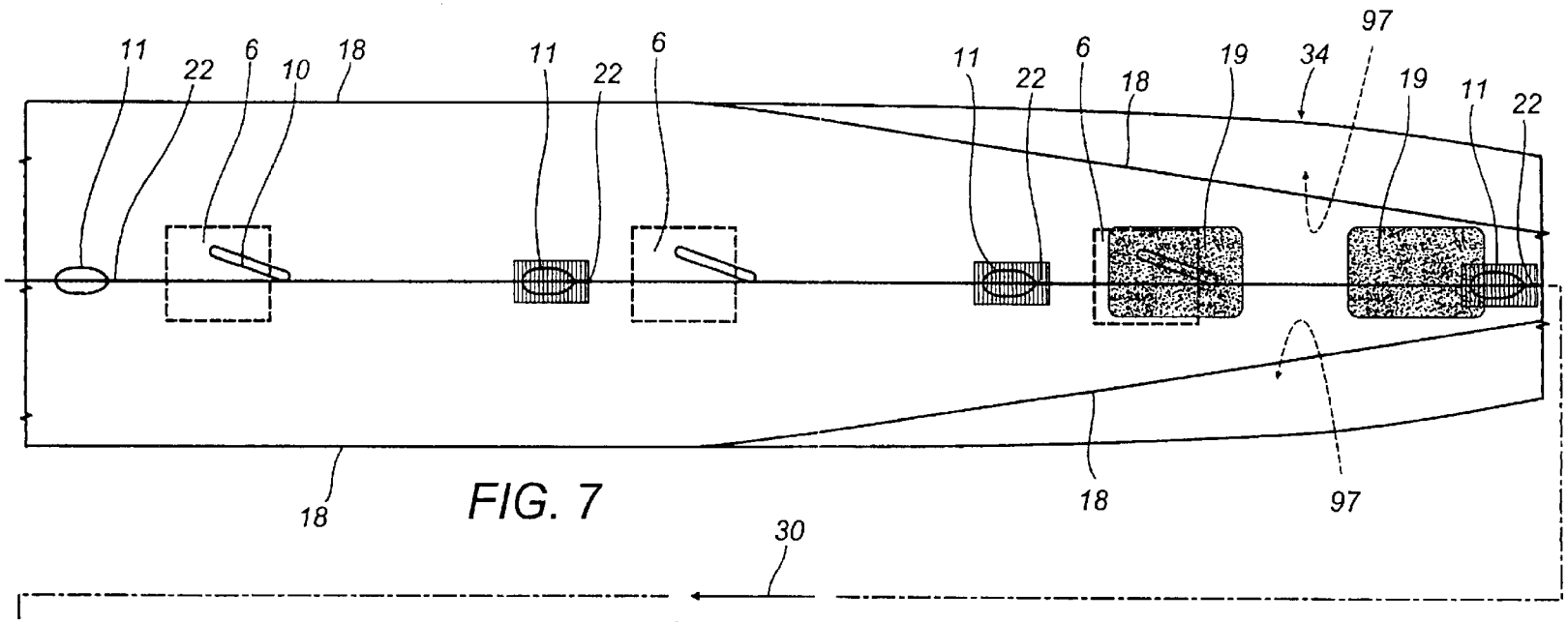
Figure 8:
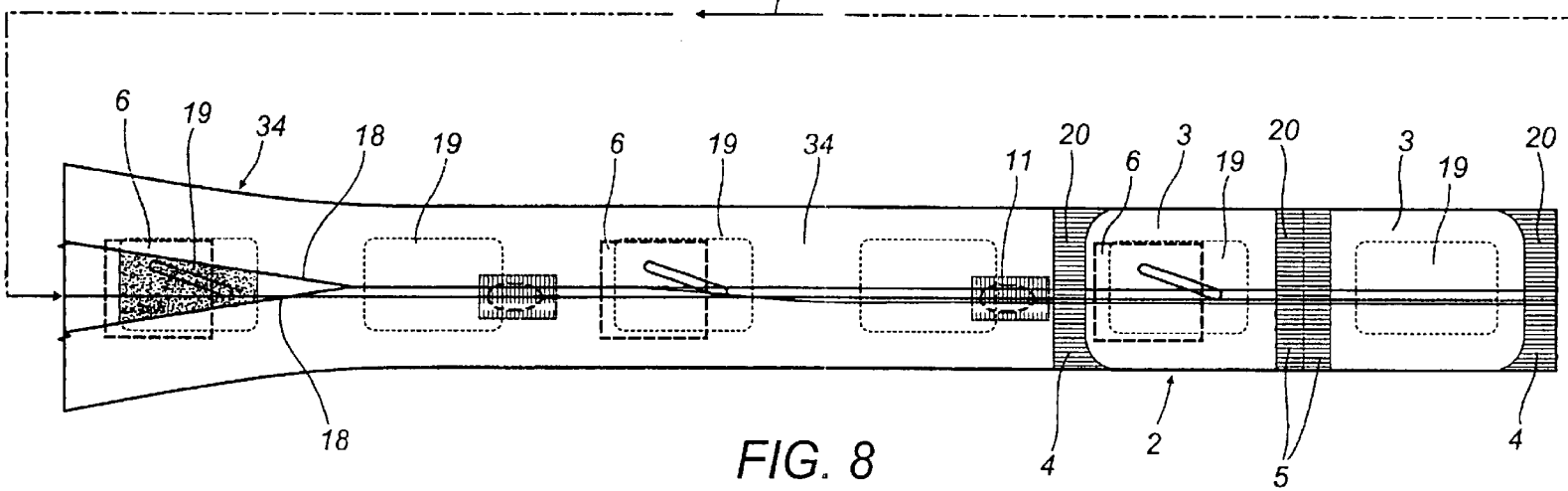
Figure 9:
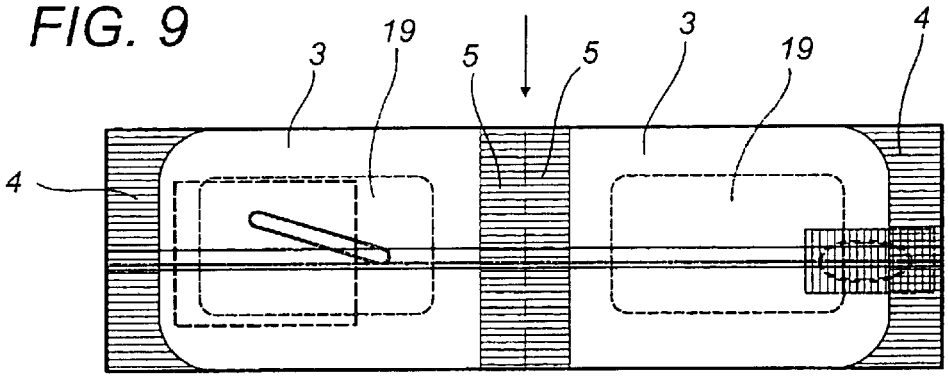
Figure 10:
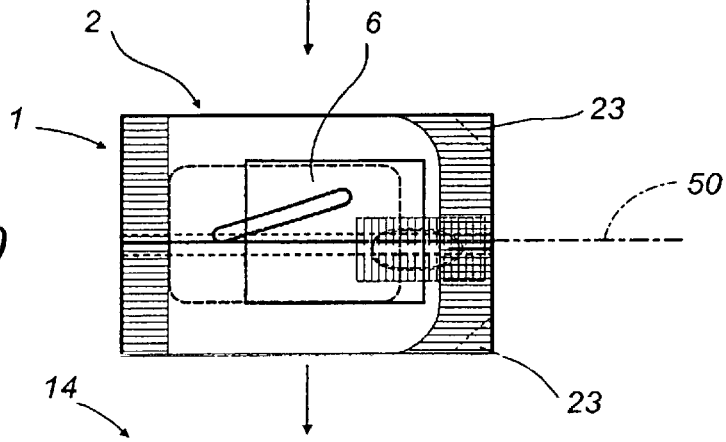
Figure 11:
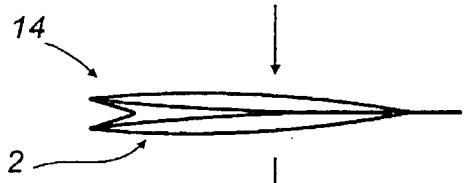
Figure 12:
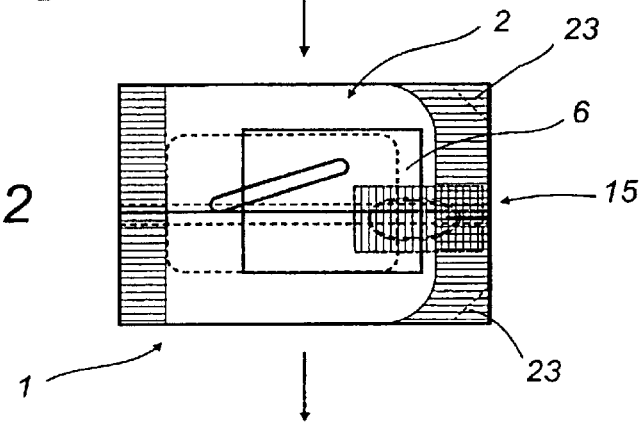
Figure 13:
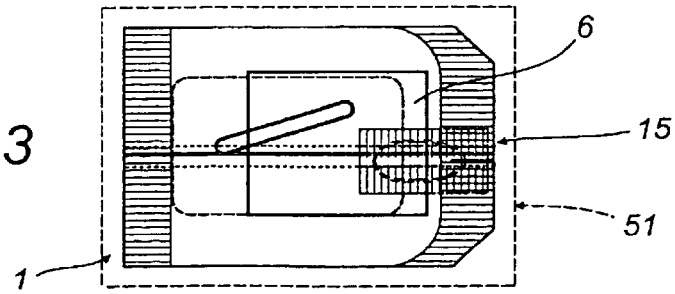

FIGS. 1, 2 and 3 of the accompanying drawings illustrate a filter bag of a type known from patent document ITBO2002A000013 and essentially comprising: a containment chamber 2 made from heat-sealable paper and comprising two pouches 3 for corresponding charges 19 of the infusion product, the pouches being sealed at a top join 4 and a bottom join 5; a tag 6 for picking up the filter bag 1 and having two flaps 9*a* and 9*b* folded onto each other; and a portion 7 of thread wound around the outside of the containment chamber 2 and extending along an outline of the containment chamber, one end of the thread being connected to the pick-up tag 6 and the other end to the top 15 of the containment filter bag 1. The thread portion 7 is longer than the outline of the containment chamber 2 to which it is attached. The excess length 8 of the thread portion 7 relative to said outline is gathered in the form of first loops 10 on the outside of the chamber 2 containing the infusion product and between the flaps 9*a* and 9*b* of the tag 6.

The filter bag 1 is made using a method which is schematically illustrated in FIGS. 4 to 13 and which comprises the steps of:

forming a row of filter bag 1 pickup-up tags 6 by cutting a web 39 of suitable material at regular intervals;

feeding a continuous thread 31 above the row of tags 6 to form, above a flap 9*a* of each of the consecutive tags 6, a row of first loops 10 of thread 31;

associating the first loops 10 of thread with the tags 6;

feeding a web 17 of heat-sealable filter paper over the continuous thread 31 and over the tags 6 connected to it;

pushing a portion of the thread through the web 17 of filter paper in such a way as to form a second loop 11 projecting from the face of the filter paper web 17 opposite the face adjoining the tags 6;

folding the web 17 of filter paper onto itself so that its edges 18, which were initially opposite one another, are juxtaposed in such a way as to gradually form a substantially flattened tube 34 of filter paper;

depositing a succession of charges 19 of the infusion product on the filter paper web 17, before the tube 34 is definitively formed;

sealing the longitudinal edges 18 of the tube 34;

making transversal sealed joins 4, 5 upstream and downstream of each tag 6, so as to delimit a succession of closed pouches 3, each containing a charge 19 of the infusion product;

securing the portions 7 of thread between the transversal sealed joins 4 and 5 to the tube 34;

cutting the flattened tube 34, lying in a substantially horizontal position, into consecutive lengths;

folding each length of tube onto itself other about the join 5 between the two consecutive pouches 3 in such a way that the two pouches 3 are mutually superposed;

joining the pouches 3 by a top sealed join 4; and trimming the corners 23 of the top join 4.

Figure 14:
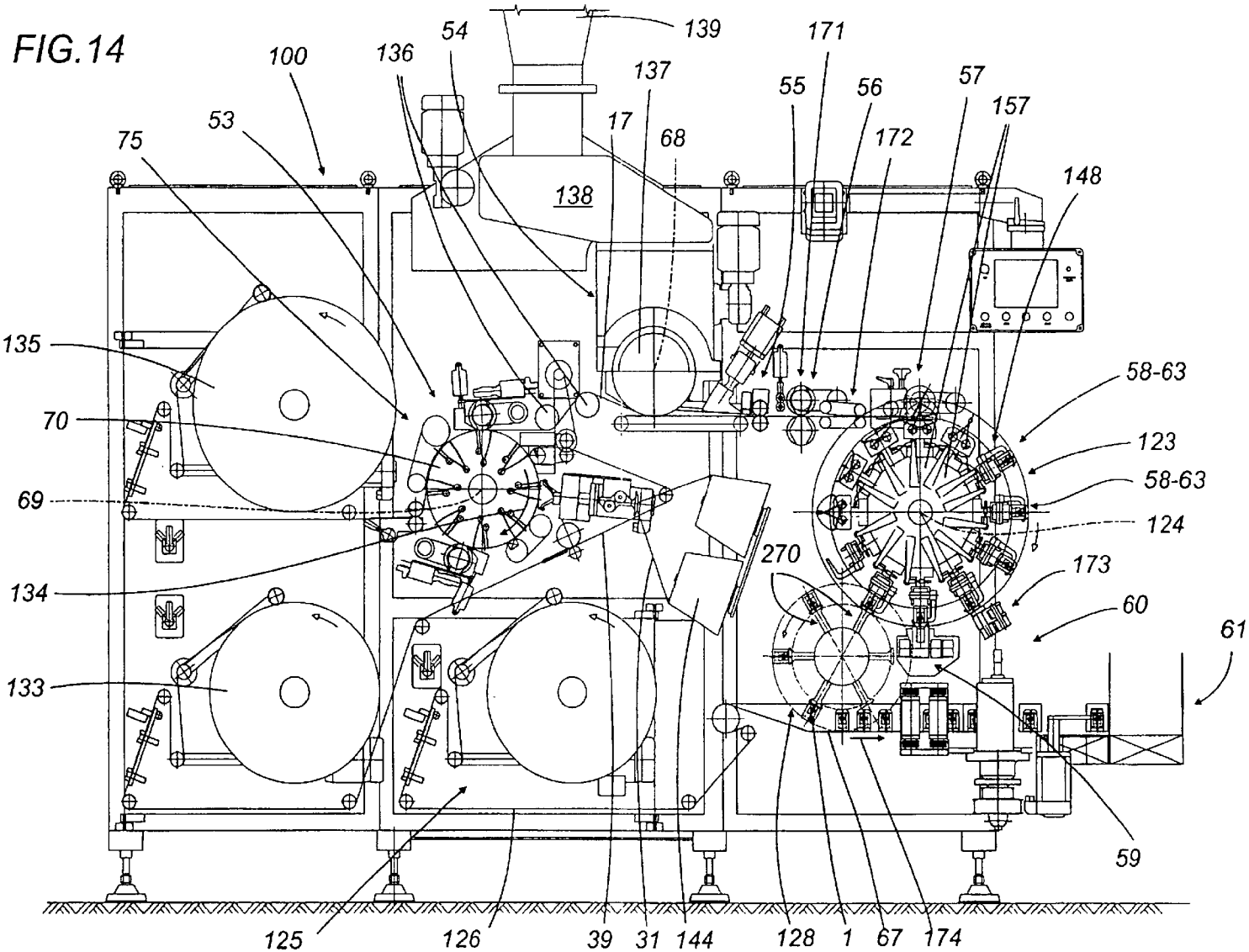
FIG. 14 is a schematic, front assembly view of a machine according to the invention shown in elevation.

With reference to FIG. 14 of the accompanying drawings, the numeral 100 denotes in its entirety an automatic machine for making filter bags 1—of the type illustrated in FIGS. 1, 2 and 3—containing an infusion product such as tea, chamomile, herbal teas or other similar products.

The filter bag 1 and the method used to make it are known from patent document IT BO2002A000013 in the name of the same Applicant as the present. FIGS. 1 to 13 are also taken from that document in order to better illustrate the machine forming the specific subject matter of the present invention.

The machine 100 essentially comprises a structure including the following, arranged in suitable operating sequence: a unit for preparing and feeding the materials used to make the filter bags 1, labeled 53 as a whole; an assembly for metering the infusion product, labeled 54 as a whole; a forming unit 55, a dividing unit 56 and a cutting unit 57. Downstream of the cutting unit 57, the machine 100 further comprises: a plurality of units for folding and turning the filter bags 1, labeled, respectively, 63 and 58, mounted on a first revolving wheel 123; a unit 173 for sealing the pouches 3 of the filter bags 1; a trimming unit 59; a unit, labeled 60 as a whole, for individually wrapping the filter bags 1 in envelopes; and a cartoning unit, labeled 61 as a whole.

Figure 15:
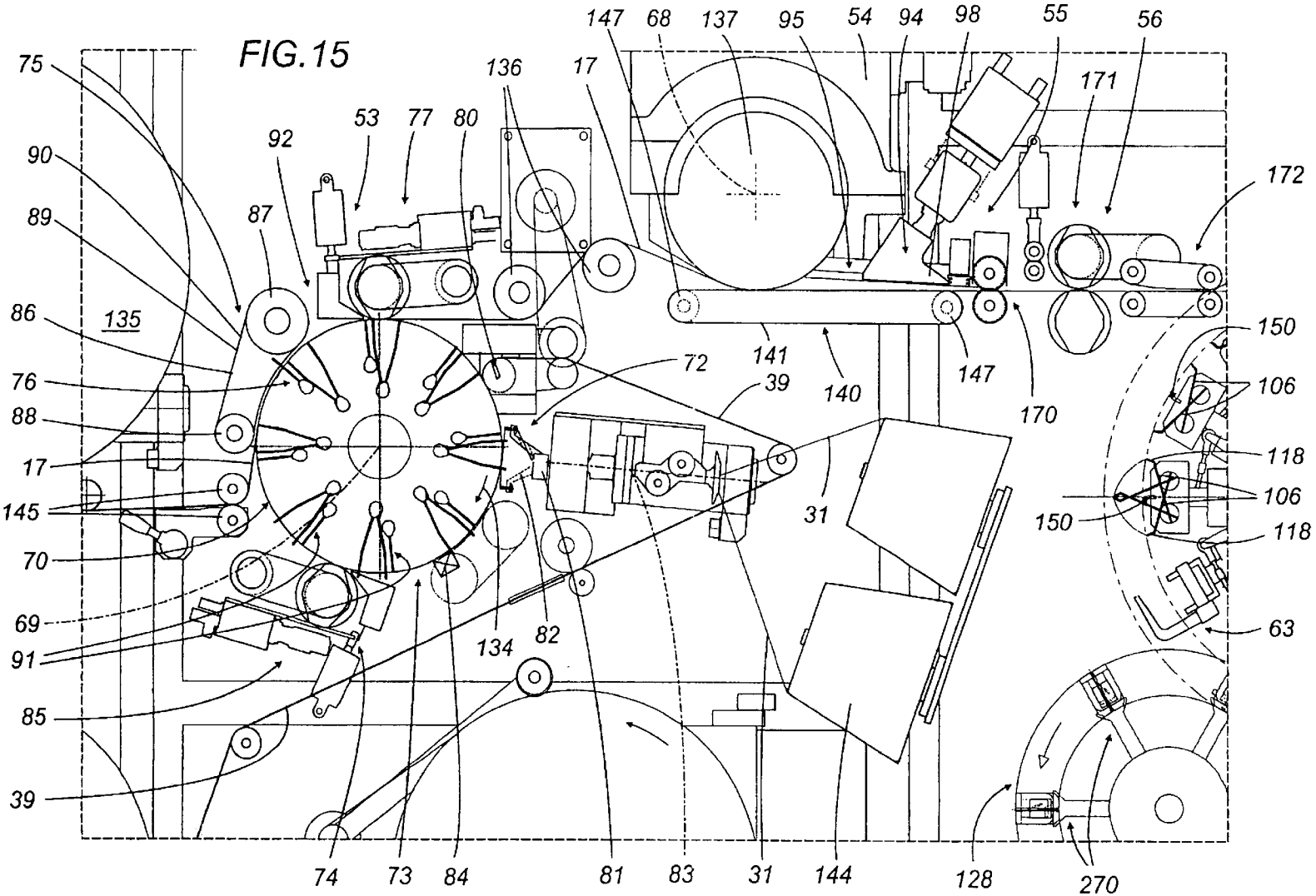
FIG. 15 is a scaled-up detail view illustrating a part of the machine of FIG. 14 comprising a unit for preparing the materials used to make the filter bags.

The unit 53 for preparing and feeding the materials comprises a power-driven wheel 70 which revolves about a horizontal axis 69 and around which there are arranged a plurality of operating means—better illustrated in FIG. 15 and labeled 71, 72, 73, 74, 75, 76 and 77—following each other in succession around the edge of the wheel 70 according to the latter's direction of rotation indicated by the arrow 134 in the illustration.

Figure 16:
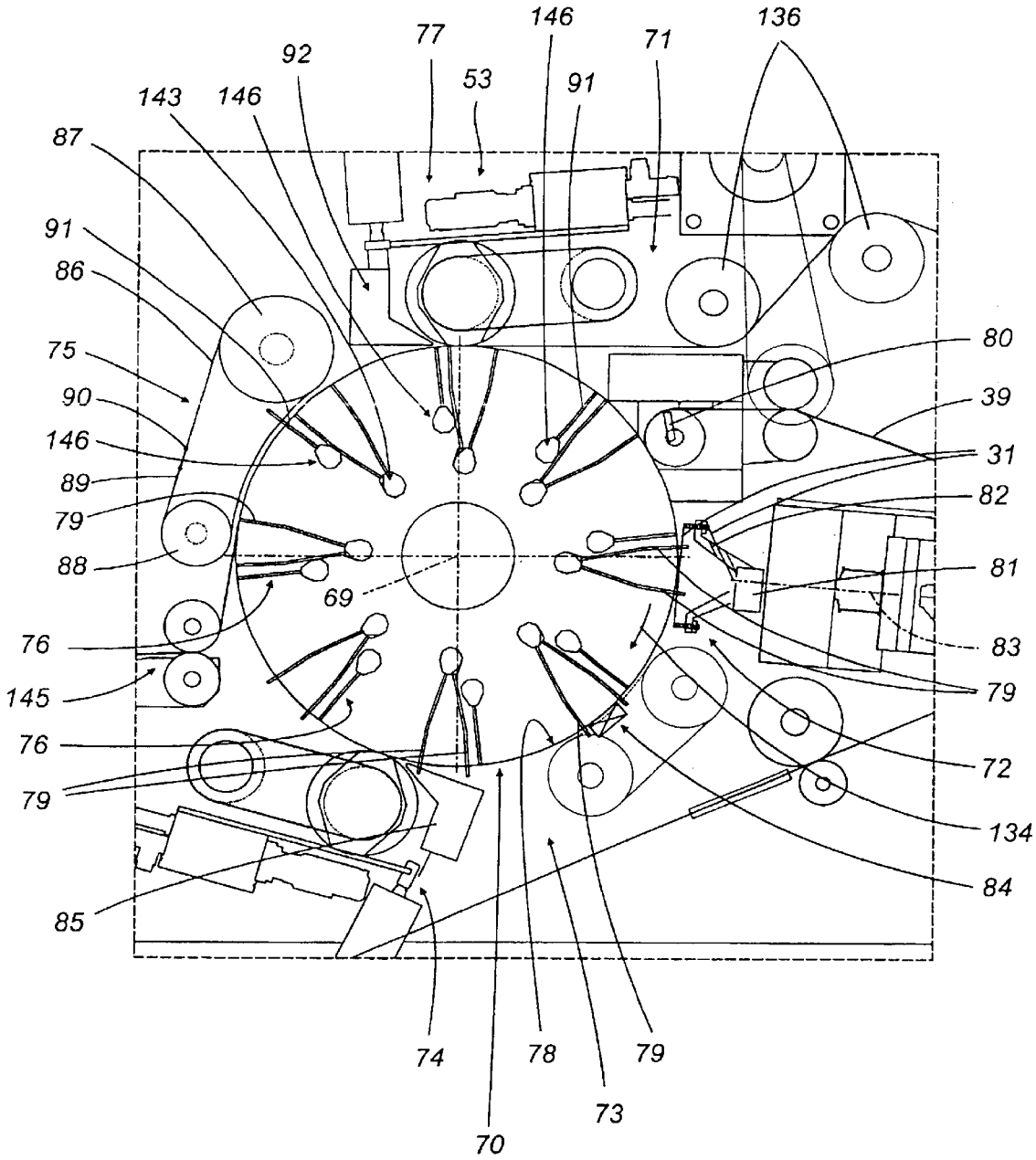
FIG. 16 is a further scaled-up view illustrating the unit of FIG. 15 in greater detail.
Figure 17:
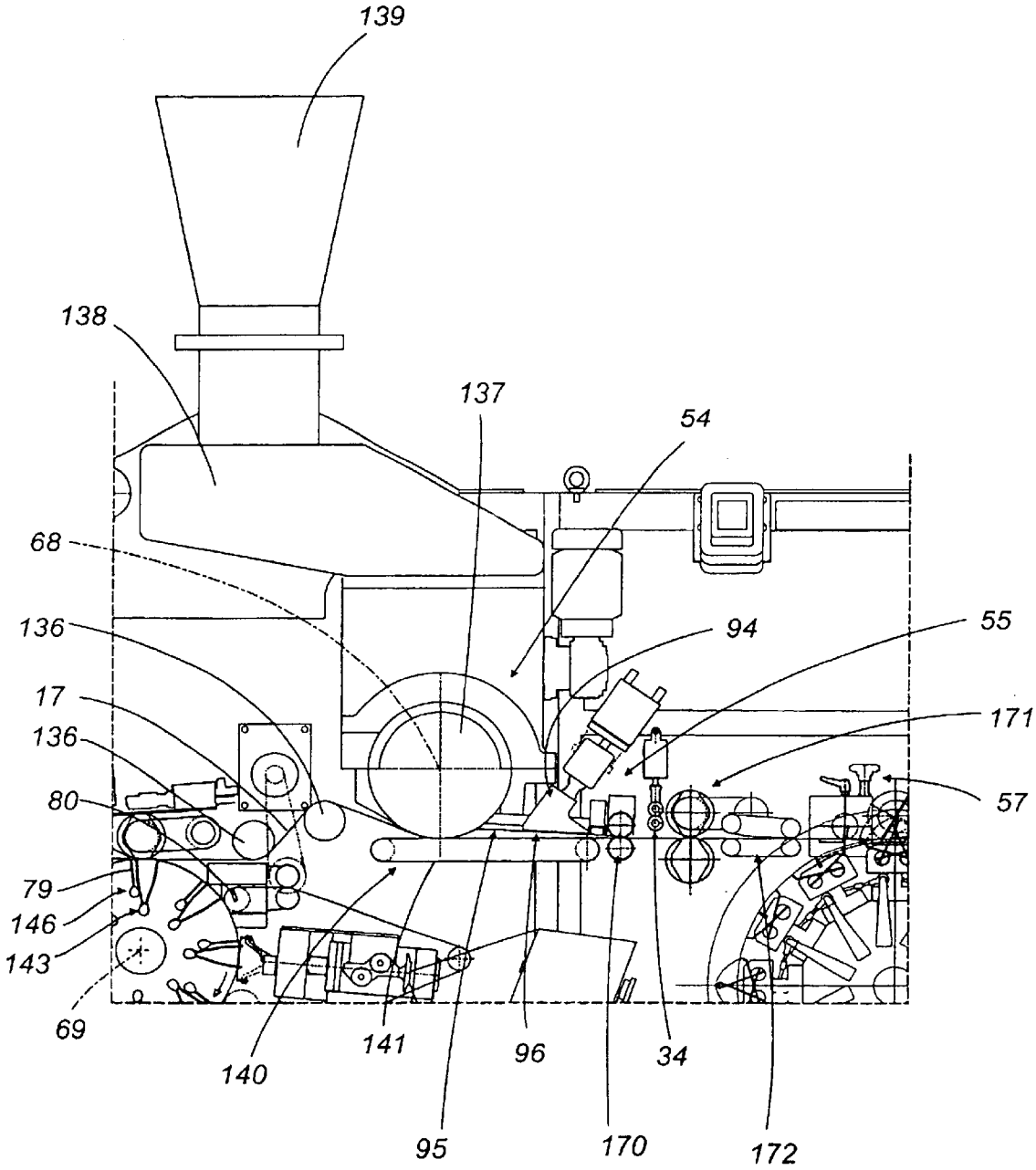
FIG. 17 is a scaled-up detail view illustrating a part of the machine of FIG. 14 comprising an assembly for metering the infusion product and a unit for forming and sealing the containment chamber pouches of the filter bags.
Figure 18:
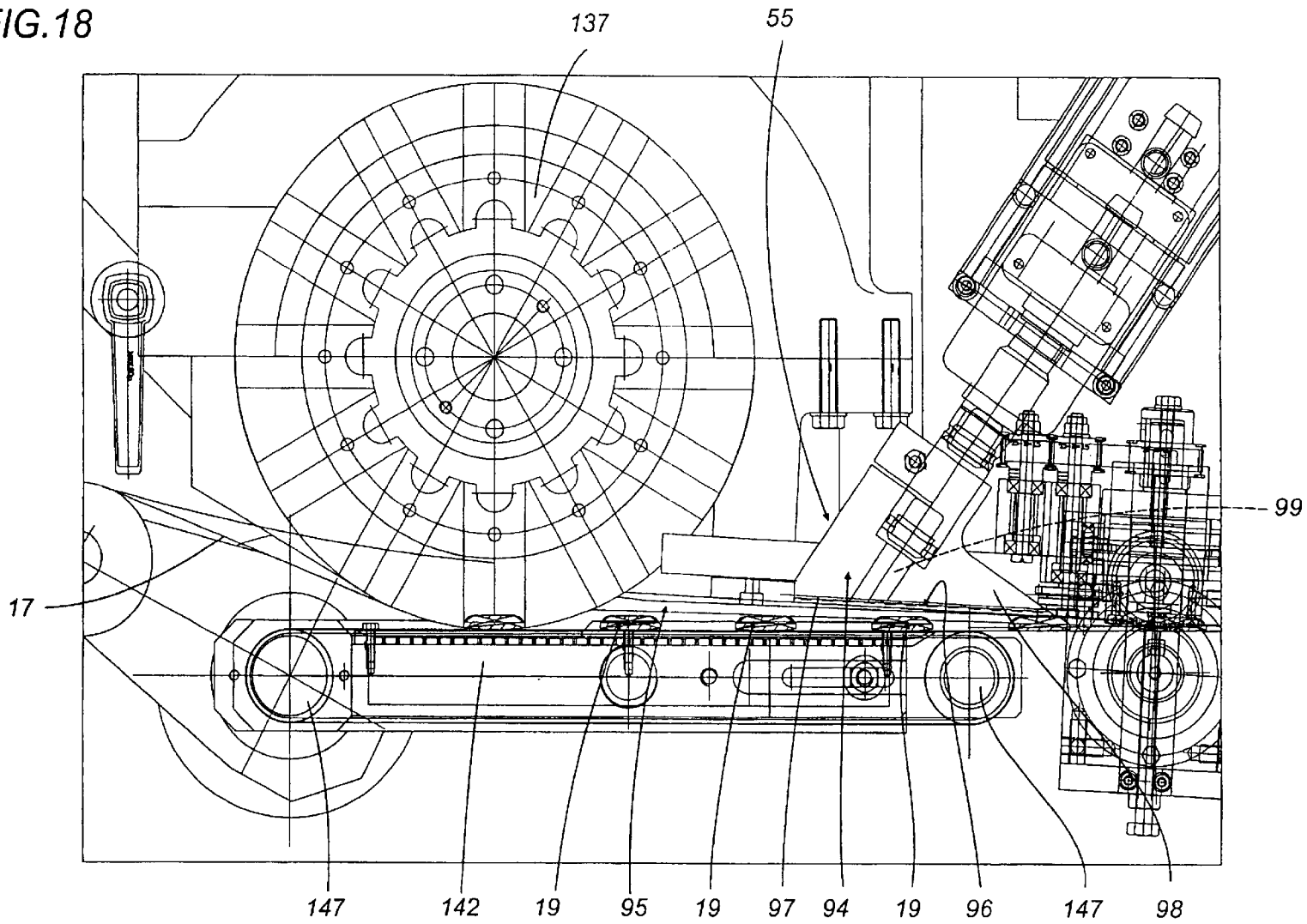
FIG. 18 is a scaled-up detail view showing a part of the machine illustrated in FIG. 14.

The first operator means 71—see also FIG. 16—form the filter bag 1 pick-up tags 6 from a web 39 of suitable material, preferably paper, bearing a layer of glue that can be thermally activated, and arranging them in suitable order around the edge of the revolving wheel 70.

To do this, the first means 71 comprise: a rotary knife 80 mounted near the edge of the revolving wheel 70; and retaining means 78 for holding the tags 6 to the edge of the wheel 70, housed inside the body of the wheel and operating preferably by pneumatic suction. The first means 71 further comprise a series of pegs 79, distributed at regular intervals around the body of the wheel 70 and positioned on each side of the retaining means 78. Under the action of suitable cam drives 143, the pegs 79 periodically extend past the edge of the wheel 70 in such a way as to protrude radially from the latter.

The knife 80 cuts the web 39, which is unwound from a roll 133, into lengths, each of which corresponds to a single tag 6. The lengths are successively captured by the retaining means 78 which attract them to the wheel 70 and place them at regular intervals between the successive pairs of pegs 79, holding them in close contact with the wheel 70 during the latter's full rotation.

The second means 72 comprise a tubular spindle 81, which is rotationally driven about an axis of rotation 83, and which is equipped, at the end of it facing the wheel 70, with an arm 82 that is transversal to the axis of rotation 83 and projects towards the wheel 70. A bobbin 144 feeds the spindle 81 with a continuous thread 31.

As the spindle 81 rotates about its axis 83 in front of a pair of pegs 79 protruding as they pass by on the revolving wheel 70, its arm 82 creates around the pegs 79 the first loops 10 of thread each located at a position corresponding to a pickup tag 6 carried below it by the revolving wheel 70.

Thus, as the thread 31 is unwound from the bobbin 144 by the rotation of the wheel 70, it extends continuously around the edge of the wheel and, in so doing, progressively forms the first thread loops 10 above each of the tags 6 carried by the wheel 70, at the same regular intervals as the tags 6.

The third means 73 comprise a fixed folding element 84, helical in shape and suitably located to intercept a lateral edge of the tag 6 as the latter, moving past as one with the revolving wheel 70, comes into contact with the folding element 84 itself.

For delimiting two contiguous flaps 9*a* and 9*b* on each tag 6, the paper web 39 from which the tags 6 are cut has a fold line 21 running lengthwise along the middle of the web 39, and thus, when a tag 6 strikes the fixed helical folder element 84, one of its flaps 9*a* is gradually rotated about the fold line 21 and folded onto the other flap 9*b*.

Thus, thanks to the action of the folder 84, the flaps 9*a* and 9*b* of the tags 6 are folded onto each other, while the first thread loops 10, still held by the pegs 79, are enclosed between the flaps 9*a* and 9*b*.

The fourth means 74 comprise a first heating device 85 associated with the outer edge of the wheel 70 and designed to thermally activate the layer of glue on the tags 6. Consequently, as the wheel 70 rotates, the tags 6 interact with the heater 85 and are pressed against the wheel 70 behind them in such a way that the flaps 9*a*, 9*b* of the tags 6 are joined together and the first loops 10 of thread 31 are securely held between them.

The fifth means 75 comprise a looped flexible element 86 that is trained around a pair of pulleys 87, 88, at least one of which is power driven, and that lies against a peripheral portion of the wheel 70. The flexible element 86 is embodied preferably, but not exclusively, as a stainless steel chain whose links 89 and pins 90 do not require lubrication.

A web 17 of filter paper bearing a layer of glue to be thermally activated is unwound from a roll 135 and, after moving through a feed element 145 is fed tightly between the flexible element 86 and the edge of the wheel 70 over the continuous thread 31 and the tags 6 connected to it.

The coordinated drive of the flexible element 86 and of the wheel 70 thus causes the filter paper web 17, the continuous thread 31 and the tags 6 to move together as one in well-defined positions relative to each other.

The sixth means 76, associated with the revolving wheel 70, comprise needles 91 which are housed in the body of the wheel 70 and which are driven by actuating cam elements 146 in a radial direction relative to the wheel 70 and synchronized with it. The needles 91 are made to rhythmically protrude from the edge of the wheel 70 towards, and in synchrony with, the flexible element 86 which is pressing the filter paper web 17 in such a way that the needles 91 go through the links 89 of the chain without hitting the chain link pins 90. As the needles 91 move, they strike the continuous thread 31 lying on the edge of the wheel 70 and push the thread 31 through the filter paper web 17 to the opposite face of the filter paper web 17 adjacent to the flexible element 86.

This creates second loops 11 on the thread 31 which extend outwards from the wheel 70 and lie on the face of the filter paper web 17 opposite the face against which the tags 6 are lying.

To reduce wear on the needles 91, the filter paper web 17 coming off the roll 135 might have ready-made incisions or slits 22 in it at regular intervals so as to facilitate the passage of the needles 91 through the filter paper web 17. Alternatively, a filter paper web 17 without incisions might be used and, instead, the wheel 70 might be equipped with suitable means designed to make the incisions 22 in the filter paper web 17 just before the needles 91 are pushed through it.

The seventh means 77 next encountered by the filter paper web 17 and the thread 31, now mutually interacting and joined to each other as they move forward in parallel, comprise a second heating device 92, associated with the edge of the revolving wheel 70. This heating device 92 thermally activates the layer of glue on the filter paper web 17 in a limited area around each of the second loops 11 as they move past. At the same time, the heating device 92 also acts on the underlying tag 6 and thermally activates the glue on an edge 37 of the tag 6 facing the opposite face of the filter paper web 17. Thus, the operation of the seventh means 77 simultaneously activates the glue on the filter paper web 17 and on the tags 6, causing the filter paper web 17 to be attached to the second thread loops 11 and to the tags 6.

When the filter paper web 17 leaves the heating device 92, it moves away from the revolving wheel 70 and the second thread loops 11 are by that time attached to one side of the filter paper web 17 and the continuous thread 31 attached to the other side of it at the tags 6. The first loops 10 of the thread 31 are gathered and held securely between the tag flaps 9*a* and 9*b*.

It should be noticed that the structure of the apparatus as described above for preparing and feeding the filter bag materials enables the wheel 70 to revolve continuously with, also moving continuously around it, all the filter bag materials, namely: the thread 31, the tags 6 and the filter paper web 17. It should also be noticed that the few reciprocating movements—which, as is well known in the trade, usually slow down machine operation—regard, in the machine according to the invention, only the pegs 79 and the needles 91 which are very light weight and which perform very small movements during the rotation of the wheel 70 which is practically unaffected by them. This means that the apparatus 53 for preparing and feeding the filter bag materials can operate at very high speeds, significantly contributing to the high performance of the machine 100.

After leaving the unit 53 that prepares and feeds them, the three filter bag materials, namely, thread 31, tags 6 and filter paper web 17, move together as one through a system of transfer rollers 136 to reach the metering assembly 54, the forming unit 55, the dividing unit 56 and the cutting unit 57.

The metering assembly 54 is equipped with a metering wheel 137 that revolves about a horizontal axis 68 and is associated with an overlying container 138, featuring a hopper 139, which contains the infusion product.

Under the metering wheel 137, the metering assembly 54 is equipped with an endless conveyor belt 140 in which the endless belt 141 is trained around a pair of pulleys 147, one of which is power-driven. Between the moving sections of the belt 141 and, in particular, in contact with the upper section, there is an air vacuum suction chamber 142. The endless belt 141 has through holes in it which put the space above the conveyor 140 in communication with the suction chamber 142 below. Thanks to the air vacuum in the chamber 142, the filter paper web 17, associated with the thread 31 and with the tags, is held down against the belt 141 and fed as one with it, in a flat, substantially horizontal position, in a direction away from the filter bag material preparation and feed unit 53. While the filter paper web 17 is being fed in this way, the metering wheel 137 places charges 19 of infusion product of predetermined weight on the web 17 at suitable predetermined intervals from each other.

Next, the forming unit 55, which is situated immediately after the metering wheel 137 but outside the sphere of influence of the suction chamber 142 folds the filter paper web 17 onto itself as it advances and in such a way as to gradually form it into a tube 34. To do this, the forming unit 55 uses a folding device 95 and a sealing device 94 mounted in line with the folding device 95 and operating from inside the tube 34. Thus, as it is being formed, the tube 34 is sealed around one end of the sealing device 94 and in such a way, obviously, as to enclose the charges 19 of infusion product previously placed on the filter paper web 17.

The sealing device 94 has the shape of an elongated solid tapering to a point at one end positioned in such a way that its other end, the wide end, faces the direction opposite the direction in which the web 17 of filter paper is moving away from the filter bag material preparation and feed unit 53. The sealing device 94 has oblique side walls 98, bearing nozzles 96, which have the inside faces 97 of the tube 34 facing them. Through the nozzles 96—embodied as apertures passing through the side walls 98 of the sealing device 94—a stream of hot air supplied by a conduit 99 inside the sealing device 94 is blown against the juxtaposed faces 97 of the longitudinal edges 18 of the tube 34. The layer of glue on the edges 18 of the tube 34 of filter paper 17 is thus activated, enabling pressure rollers 170 pressing against each other in the forming unit 55 to seal the tube 34 of filter paper 17 along its longitudinal edges 18.

The dividing unit 56 encountered next by the tube 34 is equipped with pressure rollers 171 pressing against each other in such a way as to make pairs of transversal sealed joins 4, 5 upstream and downstream of each tag 6. These sealed joins 4, 5, made by thermally activating the layer of glue on the filter paper web 17 along lines transversal to the tube 34, divide the tube 34 into a succession of substantially flattened containment chambers 2 containing charges 19 of the infusion product.

The tube 34 continues moving forward lengthwise, transported by suitable conveyor belts 172 that press it on both sides, and next reaches the cutting unit 57. This cuts the tube 34 into a consecutive series of flattened lengths lying in the original longitudinal direction of the tube 34, each length constituting the containment chamber 2 of a filter bag 1, by now fully sealed and containing the infusion product.

On leaving the cutting unit 57, the lengths of tube 34, comprising two contiguous pouches 3, each containing a charge 19 of product, lie in a substantially horizontal position with the pouches 3 arranged one after the other: arranged and oriented in this way, each tube length next reaches one of the folding units 63 and turning units 58 on the first wheel 123, immediately downstream of the cutting unit 57.

The folding unit 63 is designed to fold the length of tube 34, initially lying in a horizontal plane, in such a way that the contiguous pouches 3 of the containment chamber 2 are moved to a mutually superposed vertical position typical of filter bags 1 of the type with two lobes or pouches 3.

Figure 19:
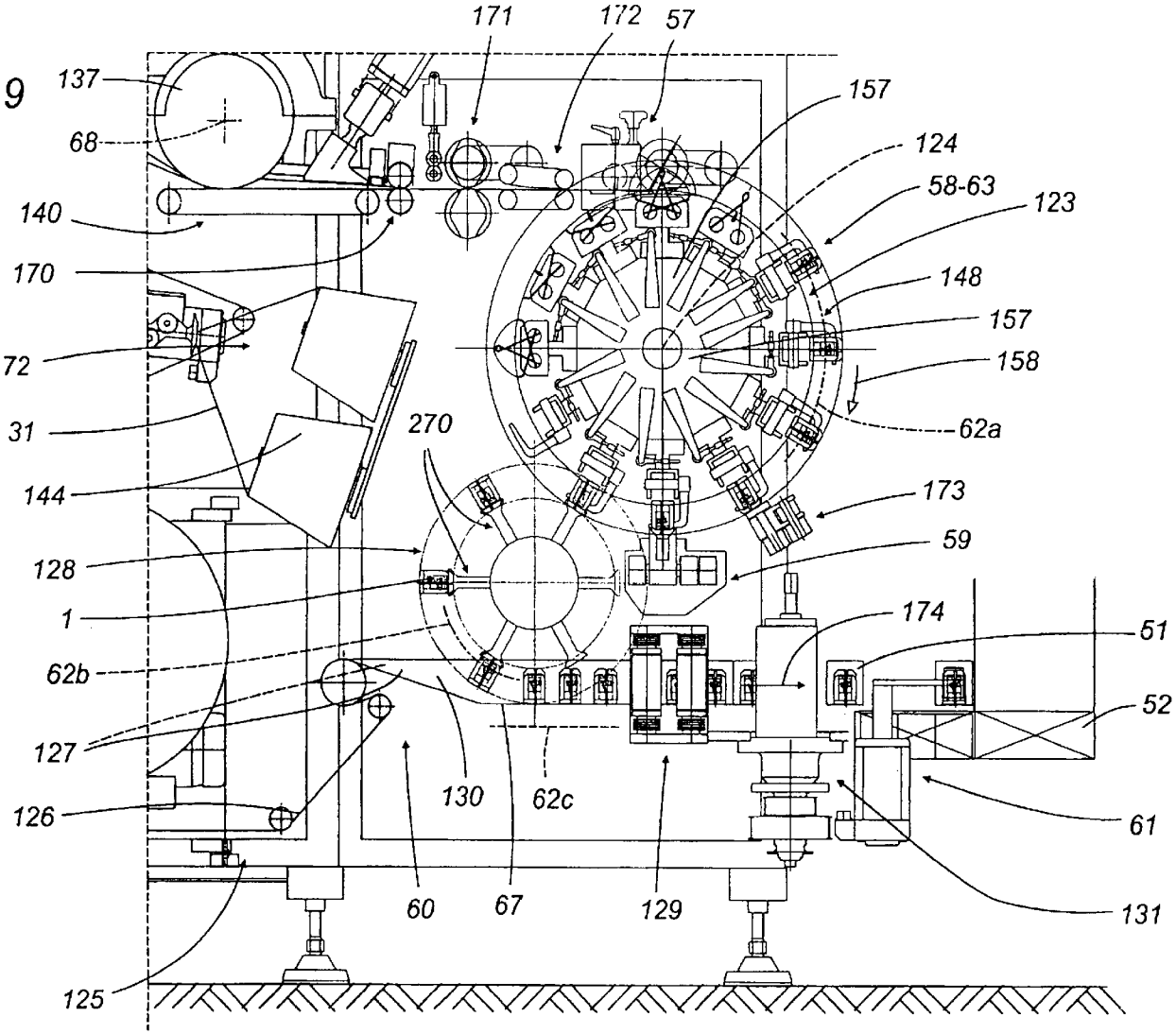
FIG. 19 is a scaled-up detail view illustrating a part of the machine of FIG. 14 comprising a unit for individually wrapping the filter bags in envelopes and a unit for collectively packaging the wrapped filter bags in cartons.

The turning unit 58, on the other hand, is designed to vary the orientation of the plane in which the containment chamber 2 of the filter bag 1 lies, rotating it through 90° relative to the plane in which the filter bag 1 lies when it enters the turning unit 58. More specifically, since the folding unit 63 and the turning unit 58 operate—as described in more detail below—in conjunction with the first gripper wheel 123, which is driven rotationally about a horizontal axis 124, the basic purpose of the turning unit 58 is to rotate the filter bags 1 relative to the wheel 123 in such a way that they lie in a plane parallel to the plane in which the wheel 123 lies, that is, perpendicularly to the axis of rotation 124, as shown in FIG. 19 of the accompanying drawings.

In the exemplary but non-restricting embodiment of the machine 100 being described for making two-lobed filter bags 1, the folding units 63 and the turning units 58 are preferably and advantageously combined in pairs to form a plurality of identical operating units 148, distributed at regular intervals around the edge of the first gripper wheel 123, so that the filter bags 1 are folded and turned continuously.

Figure 20:
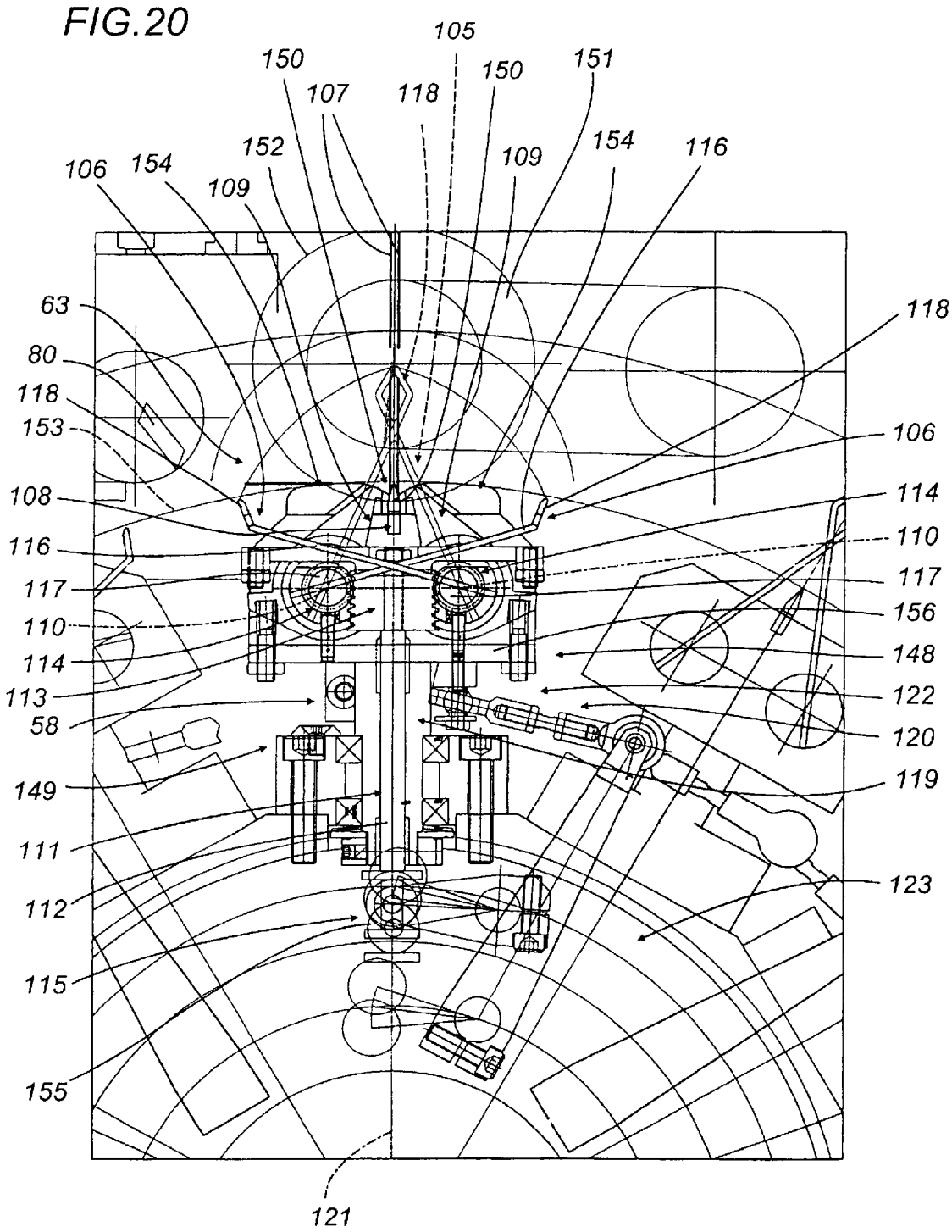
FIG. 20 is a scaled-up view of a detail from FIG. 19.
Figure 21:
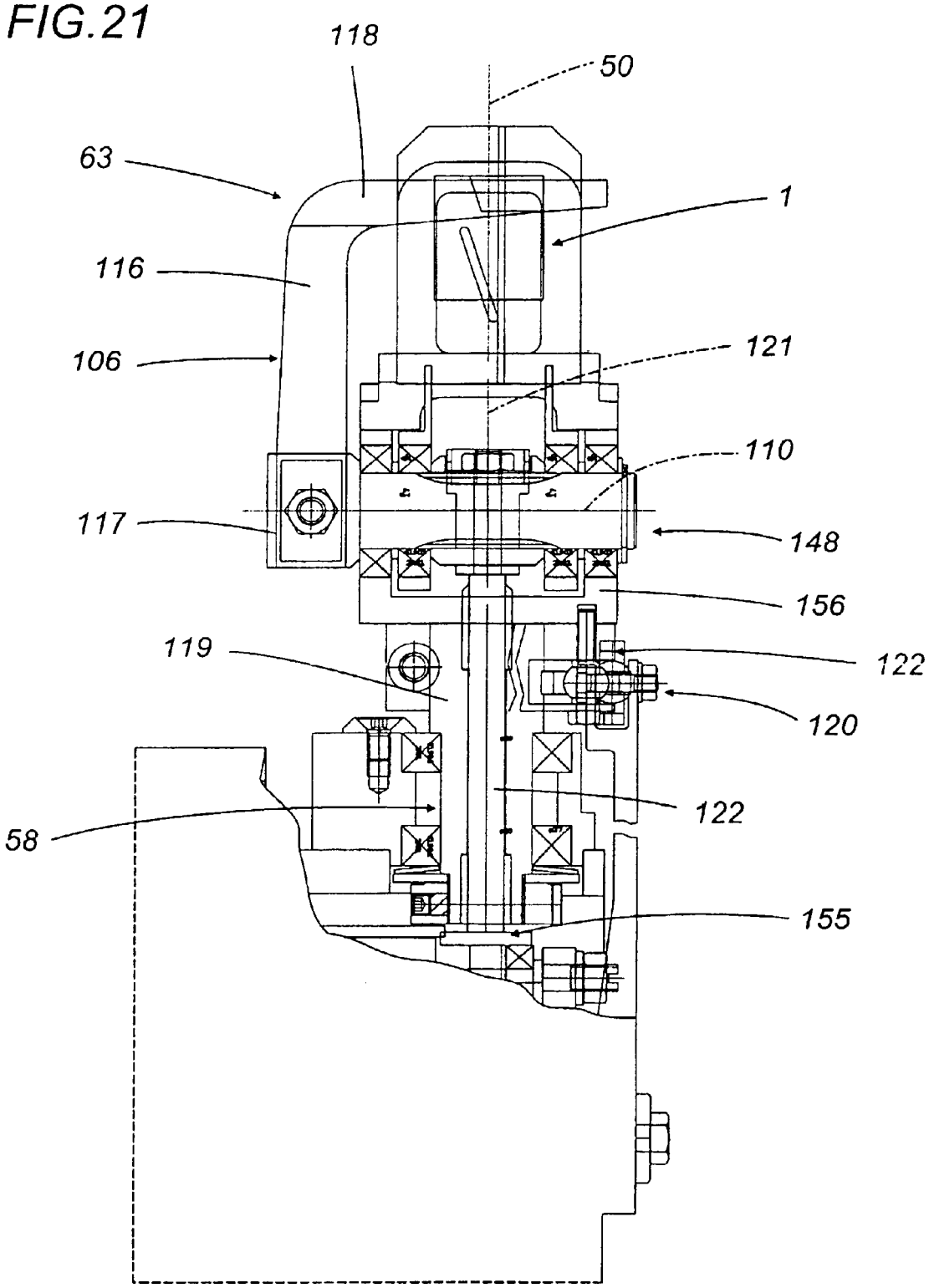
FIG. 21 is a scaled-up side view of the detail of FIG. 20.

As is more clearly discernible from FIGS. 20 and 21, each operating unit 148 associated with the first wheel 123 essentially comprises: a device, labeled 105 as a whole, for clamping the lengths of tube 34; a system of grippers 106, pivotably mounted around horizontal axes 110; and revolving heads 149 that unitarily mount the clamping device 105 and the system of grippers 106 and that are driven rotationally about axes of rotation 121 which are radial relative to the wheel 123.

Looking in more detail, the device 105 for clamping the lengths of tube 34 comprises a pair of folding blades 107; a folding counterblade 108 and a pair of elastically opposing pressers 109 mounted on each side of the folding counterblade 108 in such a way that they can swing about the fixed axes 110 of the head 149 and designed to press against the sides of the counterblade 108 by elastic reaction.

The folding blades 107 consist of two parallel thin flexible plates mounted on a revolving wheel 151 outside the first gripper 106 mounting wheel 123. The folding counterblade 108 has a tapering end 150 and is mounted radially on the first gripper 106 mounting wheel 123.

The first gripper 106 mounting wheel 123 also mounts the pressers 109 which press, by elastic reaction, against the tapering end 150 of the counterblade 108.

The revolving wheel 151 mounting the folding blades 107 and the first gripper 106 mounting wheel are coupled in rolling relationship of relative primitive circles 152, 153, so that their phase-correlated rotation causes the folding blades 107 and the counterblade 108 to mesh with each other; this meshing occurring at the sealed join 5 between two contiguous pouches 3 of the interposed length of tube constituting the filter bag 1. Thanks to this meshing, the sealed joins 5 of the lengths of tube fed in succession to the clamping device 105 are folded between the blades 107 and the counterblade 108 which confer the typical V shape.

As can also be discerned from FIG. 20, the pressers 109, placed in elastically compliant contact against the sides of the counterblade 108, enable the folding blades 107 to move freely between them during the step of meshing with the counterblade 108. As the wheel 151 continues to rotate, the blades 107, having completed their folding action, are disengaged from the counterblade 108 and released from the lateral pressure exerted on them by the pressers 109, which now hold the filter bag 1 by the V-shaped fold.

The grippers 106 include a pair of levers 116 which are rotatably coupled at one end to fixed pins 117, centered in the same axes of rotation 110 as the pressers 109 and which, at their opposite ends, have arms 118 designed to suitably interact with the lengths of tube constituting the filter bags 1.

The levers 116 are mounted crosswise and each is therefore connected to the pin 117 of the presser 109 on the side opposite to that where it operates.

The levers 116 act in conjunction with the counterblade 108, with the pressers 109 and with suitably wide, fixed independent backs 154, in such manner as to support the filter bags in the gripper 106 mounting wheel 123 in a substantially horizontal position and at three essentially aligned points.

When the levers 116 are tightened, the bottom of the tube length constituting the filter bag is held by the counterblade 108 and by the pressers 109 while the pouches 3 of the containment chamber 2 are folded onto each other in a vertical position so that they lie in planes parallel to the axis of rotation 124 of the first gripper 106 mounting wheel 123.

In other words, the filter bag 1, already held securely at the V-shaped fold, is also held by the top end 15 of the containment chamber 2 and kept in a position such that it lies in the same plane as a meridian plane of the gripper 106 mounting wheel 123, meaning by "meridian plane" a radial plane of the gripper mounting wheel 123 containing the axis of rotation 124 of the wheel 123 itself.

The opening and closing movement of the gripper 106 levers 116 is accomplished by an actuating device comprising two articulated pinions 114 also rotatably mounted on the pins 117 of the pressers 109.

The pinions 114 are attached to the respective levers 116 and mesh with an interposed rack 113.

A rod 112 slidable in a radial guide in the gripper 106 mounting wheel 123 imparts rotational drive simultaneously on the levers 116 in phase with the angle of rotation traveled by the gripper 106 mounting wheel 123, the sliding motion of the rod 112 being imparted by an actuating element 115, consisting of a cam 155 that comes into contact with the end of the rod 112 furthest away from the levers 116.

As to the rotation of the filter bags 1 about their longitudinal axes 50, that is to say, about a radial axis 121 of the first gripper mounting wheel 123, FIG. 20 shows that the operating units 148 comprise a platform 156 fixed to a tubular upright 119 supported by the first gripper 106 mounting wheel 123.

The platform 156 supports the clamping device 105 and the grippers 106.

The upright 119, which houses the rod 112 that actuates the rack 113 and the pinions 114 acting on the pressers 109 of the clamping device 105 and on the levers 116 of the grippers 106, is mounted in such a way that it can rotate about a radial axis 121 of the gripper 106 mounting wheel 123.

The upright 119 is rotationally driven by actuator means 120 comprising linkages 122, with ball joints, driven in coordinated phase with the angle of rotation described by the first gripper 106 mounting wheel 123.

The linkages 122 impart a rotational movement to the platform 156 such that the filter bags 1 are turned through 90° relative to the positions they had prior to being turned. Thus, the filter bags 1 now lie in planes parallel to the parallel planes 157 of the gripper 106 mounting wheel 123, meaning by "parallel planes" the planes transversal to the axis of rotation 124 of the first wheel 123 (FIG. 19).

It should be noticed that the operating units 148 are advantageously structured to enable the filter bags 1 to be folded and turned as they move, while the first gripper 106 mounting wheel 123 rotates continuously.

The continuous motion of all the materials through the machine 100 which started in the unit 53 for preparing and feeding the filter bag materials and continued in the metering assembly, in the sealing unit 55, dividing unit 56 and cutting unit, thus carries on into the units 63 and 58 for folding and turning the filter bags 1.

The gripper 106 mounting wheel 123 is associated with: a unit 173 for sealing the pouches 3 of the filter bag 1 containment chambers 2; a unit 59 for trimming the corners 23 of the top ends 15 of the filter bags 1; and a unit 60 for forming the wrapper envelopes, the filter bags 1 coming into contact with each of these units one after the other as they move along a circular path 62 in the direction of rotation of the first gripper wheel 123, indicated by the arrow 158.

The sealing unit 173 seals the pouches 3 of the containment chambers 2 of the filter bags 1 as the latter are transported one after the other by the grippers 106 on the first wheel 123.

The trimming unit 59 cuts the corners of the filter bag 1 top ends 15 protruding from the arms 118 of the levers 116, giving the filter bags their characteristic shape. It should be noticed that this trimming operation, performed after the filter bags have been turned so that they lie in planes parallel to a parallel plane of the first wheel 123, occurs quickly and easily and does not require the gripper 106 mounting wheel 123 to be slowed down or stopped.

Between the first gripper 106 mounting wheel 123 and the envelope forming unit 60, the machine 100 is equipped with a second gripper wheel 128 which is smaller in radius than the first wheel 123 and which rotates in the opposite direction.

The peripheral speed of the second gripper wheel 128 is identical to the peripheral speed of the first gripper wheel 123. Further, the grippers on it are synchronized with the grippers 106 on the first wheel 123 so that the filter bags 1 are transferred from the operating units 148 on the first wheel 123 to the grippers on the second wheel 128 which pick them up by their top ends 15 protruding from the arms 118 of the grippers 106 on the first wheel 123 (FIG. 21).

The envelope forming unit 60 comprises: a station 125 for feeding heat-sealable paper; a heat-sealing station 129; and a cutting unit 131.

The station 125 feeds a web 126 of envelope material—in particular, a heat-sealable paper—which as it moves along a straight feed path 174 is folded onto itself about a longitudinal fold line 67 in such a way as to form two flaps 127 placed side by side and open along the top edge towards the second gripper wheel 128.

At this point, it should be noticed that the combined action of the first wheel 123, of the second wheel 128 and of the envelope forming unit 60, describe an overall feed path divided into three characteristic parts. A first section, labeled 62*a* and having the shape of a circular arc, is described by the filter bags 1 held by the operating units 148 of the first wheel 123 and moving in a clockwise direction. A second section, labeled 62*b* and also having the shape of a circular arc, is described by the filter bags 1 moving in an anticlockwise direction on the grippers of the second wheel 128 which hold them by their top ends 15. In a third section 62*c*, the feed path 62*b* of the of the filter bags 1 merges with the feed path 174 of the envelope paper moving in the same direction and the filter bags 1 are released by the grippers of the second wheel 128 onto the flaps 127 in a substantially central position.

It should also be noticed that the spacing of the filter bags 1 placed on the web 126 of envelope material can be easily controlled by simply coordinating the feed speed of the web 126 of envelope material with the peripheral speed of the second gripper wheel 128.

Next, the heat-sealing station 129 seals the web 126 of envelope material lengthwise along the open top flaps 127 and then seals the flaps 127 to each other crossways in such a way as to form a continuous flattened tube 130 divided into a succession of separate chambers, each accommodating a filter bag 1.

The cutting unit 131 then cuts the flattened tube 130 into lengths corresponding to the envelopes 51 and sends the filter bags 1, each now wrapped in an envelope 51, to a cartoning unit 61 located downstream which places a collective packaging container 52 along the outfeed path of the filter bags, feeding it in such a way as to fill it according to predetermined filling patterns.

To conclude, the machine 100 described above makes filter bags containing an infusion product where the thread connecting the top of the containment chamber to the pick-up tag of each filter bag may be of any predetermined length and where such length is in all events independent of the length of the outline of the filter bag containment chamber. This production process, besides being innovative, is also advantageously economical since the filter bags are made from only three materials.

The machine 100 is designed to minimize reciprocating motion in the production process and in such a way that the strictly indispensable reciprocating movements of some of its parts are performed while the other parts are moving continuously. Thus, the production process is not slowed down and the machine can attain production speeds that are considerably higher than those of prior machines while at the same time working continuously and offering a high level of reliability and low running costs.

After the containment chambers have been filled and sealed, the filter bags adopt a position such that they lie in a plane parallel to the plane of rotation of the gripper wheel 123. This position is maintained through all the remaining steps in the process, thus further rationalizing the production process and contributing to the maintenance of very high production speeds and to the minimizing of production costs.

It will be understood that the invention described may be useful in many industrial applications and may be modified and adapted in several ways without thereby departing from the scope of the inventive concept. Moreover, all the details of the invention may be substituted by technically equivalent elements.

What is claimed is:

1. A machine for making filter bags (1) containing an infusion product, the machine comprising the following, arranged in succession:

a unit (53) for preparing and feeding the materials used to make the filter bags (1), in which: a web (17) of filter paper bearing a layer of heat-activated glue, a continuous thread (31) and a row of tags (6) are fed in coordinated fashion and associated with each other, the filter paper web (17) and the thread (31) moving continuously through the feed unit (53), while the tags (6) and the thread (31) are associated with each other in rhythmical sequence at the ends of thread portions (7) which: lie lengthwise relative to the filter paper web (17); have a predetermined length; and are delimited at their ends by first loops (10) made in the thread (31) itself;

a metering assembly (54) which places charges (19) of the infusion product on the filter paper web (17);

a forming unit (55), a dividing unit (56) and a cutting unit (57), in the forming unit (55), the web (17) of filter paper being folded onto itself in such a way as to form a tube (34), inside which the metering assembly (56) places charges (19) of the infusion product, the tube (34) then being gradually closed by sealing it along its longitudinal edges (18); in the dividing unit (56), pairs of sealed transversal joins (4, 5) being made in the tube (34) upstream and downstream of each tag (6), these transversal sealed joins (4, 5) dividing the tube (34) into a succession of substantially flattened containment chambers (2) containing corresponding charges (19) of the infusion product; in the cutting unit (57), the tube (34) being cut into successive lengths, lying flat and lengthwise and each constituting the containment chamber (2) of a filter bag (1).

2. The machine according to claim 1, comprising, downstream of the cutting unit (57), a turning unit (58) designed to make the containment chambers (2) of the filter bags (1), received in a flattened condition, rotate about a longitudinal axis (50) to adopt a final position in which the containment chambers (2) have turned through a predetermined angle; this final position being maintained through all the remaining steps in the process which the filter bags (1) undergo in the machine (100).

3. The machine according to claim 2, wherein the filter bag (1), in the final position, has been turned about its longitudinal axis (50) through an angle of 90° relative to the position it had prior to being turned.

4. The machine according to claim 1, wherein the filter bag (1) after adopting the final, unchanging position, is made to interact with at least one of the following units: a unit (173) for sealing the pouches (3) of the filter bag (1) containment chambers (2); a unit (59) for trimming the corners (23) of the top ends (15) of the containment chambers (2); a unit (60) for wrapping the filter bags (1) in envelopes; and a cartoning unit (61) for placing the filter bags (1) in a packaging container (52).

5. The machine according to claim 4, wherein the trimming unit (59), the unit (60) for forming the envelope (51), and the cartoning unit (61) are located downstream of the tube (34) cutting unit (57) one after the other along a feed path (62) of the filter bags (1).

6. The machine according to claim 1 wherein the cutting unit (57) creates lengths of tube (34) each constituting the chamber (2) containing the infusion product and consisting of two pouches (3), each containing a charge of the infusion product, and being connected to each other along a central sealed join (5), the machine comprising a folding unit (63) where the pouches (3), initially stretched out flat one after the other, are folded about the sealed join (5) between them in such a way as to adopt a mutually superposed position.

7. The machine according to claim 2, comprising a first wheel (123) that rotates about a horizontal axis of rotation (124), the folding unit (63) and the turning unit (58) combining to form an operating unit (148) associated with the wheel (123).

8. The machine according to claim 7, wherein the folding unit (63) comprises a device (105) for clamping the infusion product containment chamber (2) and a system of grippers (106), pivotably mounted around horizontal axes (110), the clamping device being designed to hold the lengths of tube (34) by the sealed join (5) connecting two contiguous pouches (3) of the containment chamber (2), the system of grippers (106) being designed to fold the pouches (3) of the containment chamber (2) onto each other so that they are mutually superposed.

9. The machine according to claim 8, wherein the clamping device (105), while it holds the filter bag (1), also makes a fold in the bottom sealed join (5) which connects the pouches (3).

10. The machine according to claim 9, wherein the clamping and folding device (105) comprises a pair of folding blades (107) and a folding counterblade (108) on opposite sides of the filter bag (1) and pressing against each other in such a way as to make a fold in the bottom sealed join (5) between two pouches (3); pressers (109) being provided one on each side of the folding counterblade (108), which elastically oppose each other to allow the folding blades (107) to pass freely between them and the counterblade (108) when the folding blades (107) and the counterblade (108) move towards each other, and, instead, to securely hold the bottom fold in the filter bag (1) by pressing it against the counterblade (108) when the folding blades (107) move away from the counterblade (108).

11. The machine according to claim 10, wherein the folding blades 107 and the counterblade (108) are mounted on a revolving wheel (151) and on the first gripper (106) mounting wheel (123), which are coupled in rolling relationship of relative primitive circles (152, 153) in such a way that the folding blades (107) and the counterblade (108) mesh with each other.

12. The machine according to claim 9, wherein the pressers (109) are mounted in such a way that they can ,swing about respective horizontal axes (110).

13. The machine according to claim 7, wherein each gripper (106) includes a pair of levers (116) which are rotatably mounted on fixed pins (117), the levers (116) opening and closing in such a way as to make the pouches (3) of the filter bag (1) rotate about the common sealed join (5) until they are mutually superposed.

14. The machine according to claim 13, wherein the levers (116) are mounted crosswise.

15. The machine according to claim 14, wherein the levers (116) have specially shaped ends (118) designed to interact with each other and to grip the filter bag (1) close to its top end (15) as soon as the pouches (3) of the filter bag (1) are folded onto each other.

16. The machine according to claim 13, wherein the folding unit (63) comprises a device (111) for actuating the levers (116) equipped with a rack (113) mounted on a slidable rod (112) and rotatable pinions (114) which mesh with the rack (113) and which are attached to the levers (116), the sliding motion imparted on the rod (112) by an actuating element (115) in a first direction of rotation of the levers (116) causing the filter bag (1) to be folded in such a way as to superpose the pouches (3) of the containment chamber (2), and to be held by its top end (15), the sliding motion in the opposite direction placing the levers (116) in a condition in which they are ready to receive a length of filter bag tube with the containment chamber (2) pouches (3) positioned in line.

17. The machine according to claim 16, wherein the actuating element (115) comprises a cam (155) associated with the slidable rod (112).

18. The machine according to claim 7, wherein the turning unit (58) comprises a head (149) that revolves a out an axis (121) radial to the first gripper mounting wheel (123), means (120) for rotationally actuating the head (149) in synchrony with the rotation of the first wheel (123) causing the folding unit (58) to rotate in such a way as to turn the filter bag (1) so that the plane which it finally lies in is transversal to the axis of rotation (124) of the first wheel (123).

19. The machine according to claim 18, wherein the means (120) for rotationally actuating the head (149) comprise linkages (122) driven by mechanical cams in synchrony with the rotation of the first gripper wheel (123).

20. The machine according to claim 7, wherein it comprises a unit (59), which is associated with the edge of the first wheel (123) and which is designed to trim the top end (15) of the filter bag (1).

21. The machine according to claim 7, comprising a second gripper wheel (128) peripherally associated with the first wheel (123) and rotating in the opposite direction, the second wheel (128) being designed to receive the filter bags (1) one after the other from the first wheel (123) and to transport them along a corresponding section (62*b*) of a filter bag (1) feed path.

22. The machine according to claim 21, wherein the second gripper wheel (128) is designed to grip the filter bags (1) by a part of each filter bag (1) top end (15) that protrudes from the grippers (106) of the first wheel (123).

23. The machine according to claim 22, wherein the envelope forming unit (60) comprises a station (125) for feeding heat-sealable paper, in which a web (126) of material for envelopes (51) is folded onto itself about a longitudinal fold line (67) so as to define two flaps (127) placed side by side and open along the top edge towards the second gripper wheel (128), the filter bags (1) being placed between the folded flaps (127) at predetermined regular intervals.

24. The machine according to claim 23, wherein the second wheel (128) places the filter bags (1) between the flaps (127) of the web (126) of envelope material when the filter bags (1) and the web (126) of envelope material are moving along substantially coincident feed paths (62*c*, 174).

25. The machine according to claim 24, where the envelope forming unit (60) includes a heat-sealing station (129) where the web (126) of envelope material passing through with the filter bags (1) placed between its flaps (127) is sealed in such a way as to form a continuous flattened tube (130) divided into a succession of separate chambers, each accommodating a filter bag (1).

26. The machine according to claim 25, wherein the envelope forming unit (60) comprises a cutting unit (131) designed to cut the flattened tube (130) into successive lengths corresponding to the envelopes (51).

27. The machine according to claim 1, wherein the unit (53) for preparing and feeding the filter bag materials comprises the following arranged in succession around the edge of a power-driven revolving wheel (70):

first means (71) for forming filter bag (1) pick-up tags (6) from a web (39) of suitable material and arranging them in suitable order around the edge of the revolving wheel (70);

second means (72) for feeding a continuous thread (31) and forming in it first loops (10) at regular intervals from each other at positions corresponding to the pick-up tags (6) carried by the revolving wheel (70);

third means (73) acting on the tags (6) for delimiting separate faces (9*a*, 9*b*) on each tag (6) and folding these faces (9*a*, 9*b*) onto each other in such a way that the first loops (10) of thread are held between the faces (9*a*, 9*b*) of the tags (6);

fourth means (74) for joining the faces (9*a*, 9*b*) of each tag (6) to each other;

fifth means (75) for associating a web (17) of filter paper, which has on it a layer of glue that can be thermally activated, with the edge of the revolving wheel (70) and positioning it over the continuous thread (31) and over the tags (6) connected to it;

sixth means (76) associated with the revolving wheel (70) for pushing a portion (7) of the continuous thread stretched on the edge of the wheel (70) through the web (17) of filter paper in such a way as to form a second loop (11) extending outwards from the wheel (70) and protruding from a face of the filter paper web (17) opposite the face adjoining the tags (6).

28. The machine according to claim 27, comprising seventh means (77) for attaching the second thread loops (11) and the tags (6) to the filter paper web (17).

29. The machine according to claim 28, wherein the seventh means (77) for joining the filter paper web (17), the second loops (11) of thread (7) and the tags (6) comprise a second heating device (92), which is associated with the edge of the revolving wheel (70) and which thermally reactivates the layer of glue on the filter paper web (17) at an area around the second loop (11) and a layer of glue on an edge (38) of the underlying tag (6) facing the opposite face of the filter paper web (17), the second heating device (92) being designed to join one side of the filter paper web (17) to the second loop (11) and the other side of it to the tag (6).

30. The machine according to claim 27, wherein the first means (71) for forming the tags (6) comprise: a rotary knife (80) mounted near the edge of the revolving wheel (70), designed to cut a web (39) of suitable material into lengths, each corresponding to an individual tag (6); retaining means (78) for holding the tags (6) to the edge of the wheel (70); and pegs (79) projecting outwards from the edge of the wheel (70), the pegs (79) being located on each side of the retaining means (78) and acting in combination with the latter in such a way as to place the tags (6) at predetermined positions around the edge of the wheel (70).

31. The machine according to claim 27, wherein the second means (72) for feeding the continuous thread (31) comprise a tubular spindle (81), equipped with an arm (82) projecting towards the wheel (70) and transversal to the axis of rotation (83) of the spindle (81), the spindle (81) supplying the arm (82) with a continuous thread (31) and rotating the arm (82) in synchrony with the rotation of the wheel (70) in such a way as to wind at least one first loop (10) of thread around the pegs (79) protruding from the wheel edge, each first thread loop (10) being placed on a tag (6) located between the pegs (79).

32. The machine according to claim 27, where the tag (6) has two adjacent faces (9*a*, 9*b*) delimited by a central fold line (21), wherein the third means (73) for delimiting the separate faces (9*a*, 9*b*) of the tags (6) comprise a fixed folding element (84) associated with the edge of the revolving wheel (70) and designed to intercept a lateral edge of the tag (6) as the latter moves past as one with the revolving wheel (70), the fixed folding element (84) gradually folding one face (9*b*) of the tag (6) onto the other face (9*a*) in such a way as to hold the first thread loops (10) between the faces (9*a*, 9*b*).

33. The machine according claim 27, where the web (39) of tag (6) material has a layer of glue which can be thermally activated, wherein the fourth means (74) for joining the faces (9*a*, 9*b*) of each tag (6) to each other comprise a first heating device (85) associated with the outer edge of the revolving wheel (70) and located downstream of the third means (73) in the direction of rotation of the revolving wheel (70).

34. The machine according to claim 27, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

35. The machine according to claim 34, wherein the flexible element (86) comprises a chain having links (89) and pins (90) which flexibly connect the links (89).

36. The machine according to claim 27, wherein the sixth means (76) comprise a needle (91) housed inside the wheel (70) and driven by actuating elements in synchrony with it, the needle (91) being designed: to rhythmically protrude from the edge of the wheel (70); to strike the continuous thread (31); and to push a portion (7) of the thread through the filter paper web (17) to the opposite face of the filter paper web (17) adjacent to the flexible element (86).

37. The machine according to claim 36, wherein the needle (91) and the flexible element (86) are synchronized with each other in such a way that the needle (91) is driven through the chain at the links (89).

38. The machine according to claim 36, comprising means for making incisions or slits (22), at regular intervals in the filter paper web (17), in order to make it easier for the needle (91) to move through the filter paper web (17) to form the second loop (11).

39. The machine according to claim 1, wherein the forming unit (55) comprises means (94) for sealing the longitudinal edges (18) of the tube (34) working from inside the tube to reactivate the layer of glue on the filter paper web (17).

40. The machine according to claim 39, wherein the sealing means comprise a sealing element (94) equipped with nozzles (96) that emit a gaseous fluid at a suitable temperature, the sealing element (94) being located in the forming unit (55) in such a way as to be accommodated inside the filter paper tube (34) being formed from the filter paper web (17) as the latter is fed through the forming unit (55), and, as the filter paper web (17) moves, the emitter nozzles (96) directing the gaseous fluid at the faces (97) of the longitudinal edges (18) of the tube (34) facing the inside of the tube (34) itself.

41. The machine according to claim 40, wherein the nozzles are apertures (96) passing through the oblique side walls (98) and communicating with a conduit (99), which is supplied with the gaseous fluid.

42. The machine according to claim 39, wherein the sealing element (94) has the shape of an elongate , tapering solid and is positioned in such a way that its wide end faces the direction opposite the direction in which the web (17) of filter paper is being fed through the forming unit (55), the sealing element (94) having oblique side walls (98) bearing the nozzles (96) in such a way that the latter face the inside of the tube (34) in order to reactivate the glue on the faces (97).

* * * * *